US006589082B2

(12) United States Patent
Harasawa et al.

(10) Patent No.: US 6,589,082 B2
(45) Date of Patent: Jul. 8, 2003

(54) ELECTRIC CONNECTOR

(75) Inventors: Masaaki Harasawa, Yokohama (JP); Saburou Kase, Tokyo (JP); Satoru Kihara, Kawasaki (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/017,977

(22) Filed: Dec. 13, 2001

(65) Prior Publication Data

US 2002/0076993 A1 Jun. 20, 2002

(30) Foreign Application Priority Data

Dec. 18, 2000 (JP) ..... 2000-384529

(51) Int. Cl.[7] ..... H01R 13/514
(52) U.S. Cl. ..... 439/752; 439/862; 439/595
(58) Field of Search ..... 439/752, 701, 439/596, 595, 598, 862, 344, 660, 329, 55

(56) References Cited

U.S. PATENT DOCUMENTS

| | | | | | |
|---|---|---|---|---|---|
| 3,680,035 | A | * | 7/1972 | Teagno et al. | 439/595 |
| 5,051,100 | A | * | 9/1991 | Kato et al. | 439/140 |
| 5,232,373 | A | * | 8/1993 | Sawada | 439/140 |
| 5,308,265 | A | * | 5/1994 | Kaneko | 439/752 |
| 5,647,778 | A | * | 7/1997 | Yamaguchi | 439/752 |
| 5,676,562 | A | * | 10/1997 | Fukuda | 439/329 |
| 5,891,591 | A | | 4/1999 | Suzuki | |
| 5,947,775 | A | * | 9/1999 | Yamamoto et al. | 439/752 |
| 5,980,322 | A | | 11/1999 | Madsen et al. | |
| 6,095,831 | A | * | 8/2000 | Muramatsu et al. | 439/131 |
| 6,102,722 | A | | 8/2000 | Arnett | |
| 6,126,496 | A | | 10/2000 | Shinozaki | |
| 6,135,828 | A | | 10/2000 | Lalange et al. | |
| 6,217,396 | B1 | | 4/2001 | Hwang et al. | |
| 6,280,262 | B1 | * | 8/2001 | Tanaka | 439/752 |
| 6,343,960 | B1 | * | 2/2002 | Sato | 439/701 |

FOREIGN PATENT DOCUMENTS

JP 2001-307799 11/2001

OTHER PUBLICATIONS

"Electric Connector", by Masaaki Harasawa et al.; U. S. patent application 10/017,983; Dec. 13, 2001, pp. 1 to 25 and 15 sheets of drawings.
"Electric Connector", by Masaaki Harasawa et al.; U. S. patent application 10/017,987, Dec. 13, 2001, pp. 1 to 32 and 17 sheets of drawings.
Horikoshi et al.; U.S. patent application Publication No. 2002/0048975 A1, Publication Date: Apr. 25, 2002, entitled: "Electrical Connection Structure for Electronic Apparatus", cover sheet, 10 sheets of drawings and pp. 1 to 6.

* cited by examiner

*Primary Examiner*—P. Austin Bradley
*Assistant Examiner*—Ross Gushi
(74) *Attorney, Agent, or Firm*—W. F. Fasse; W. G. Fasse

(57) ABSTRACT

An electric connector is connected to an electric wire of a first article, and is to be fitted onto the first article and/or a second article. The contact of the electric connector shall directly contact a conductive part of the second article. To prevent the electric wire or the wired contact from coming of the housing of the connector, a retainer is provided. The electric connector's housing has a receiving groove that is recessed into the front housing face which faces the second article, and that has an open groove end at one housing side face and a closed groove end at another housing side face. A contact is inserted into the receiving groove and includes a connecting part to be connected to the electric wire of the first article and a contacting part which is located closer than the connecting part to the closed groove end and which is to contact the conductive part of the second article. The retainer covers at least a portion of the open top of the receiving groove adjacent to the open groove end and is fitted onto the housing.

10 Claims, 18 Drawing Sheets

ELECTRIC CONNECTOR

CROSS-REFERENCE TO RELATED APPLICATIONS

This application is related to our U.S. patent applications Ser. Nos. 10/017,983 and 10/017,087, both filed on Dec. 13, 2001.

FIELD OF THE INVENTION

The present invention belongs to a field of electric connectors, which are used to electrically connect two articles that are exemplified by a printed circuit board, an electrical part, etc.

RELATED ART

Electric connectors for electrically connecting two articles include, for example, a pair of a male type crimp connector and a female type crimp connector to be coupled together, which are used extensively. The connecting form of them is, for example, that an electric wire led out of a first article is crimp-connected to a male type crimp connector, an electric wire led out of a second article is crimp-connected to a female type crimp connector, and the male type crimp connector and the female type crimp connector are coupled together to make an electrical connection.

As for the connecting structures using such electric connectors, it is keenly desired to reduce costs and to make the connectors themselves and related objects more compact.

SUMMARY OF THE INVENTION

The present inventors contemplated to reduce the number of electric connectors to be used in a connecting structure to one single electric connector by the following measures. When an electric wire is led out of the first article, a single electric connector is connected to the electric wire by crimping or insulation displacement connection, and is fitted onto the first article and/or the second article. Also, a contact of this electric connector is caused to directly contact a conductive part of the second article. This, in turn, is to reduce the costs of the connecting structure and to make it more compact. In that case, if the housing of the electric connector is provided with a groove of which one end is open, a contact is inserted into and fitted onto the groove, and the electric wire connected to the contact is led through the open end of the groove out of the housing, then the ability to fabricate the electric connector, and the workability of connecting the electric wire to the electric connector can be improved. With this arrangement, if the electric wire is subjected to a pulling and moving force and lifted from the groove, the electric wire or the wired contact may come off the housing. One objective of the present invention is to assemble a retainer onto the housing of such an electric connector so as effectively prevent the electric wire or the wired contact from coming off the housing.

To accomplish the above-mentioned objective, the present invention is an electric connector that is used to electrically connect an electric wire of a first article to a conductive part of a second article. This electric connector comprises a housing, which is fitted onto at least one of the articles and is provided with a receiving groove that is recessed into the front face which faces, when connected, toward the conductive part of the second article and that is open at one end in a side face of the housing, a contact, which is inserted into and fitted onto the receiving groove, and is provided with a connecting part to be connected to the electric wire of the first article by crimping or insulation displacement connection and a contacting part which is located closer than the connecting part to the closed end of the receiving groove and which is to contact the conductive part of the second article, and a retainer, which covers at least a portion of the receiving groove adjacent to the open end thereof and is fitted onto the housing.

The connecting part of the contact of this electric connector is connected by crimping to the electric wire of the first article, the contact is inserted into and fitted onto the receiving groove of the housing, and the retainer is fitted onto the housing. Or the contact is inserted into and fitted onto the receiving groove of the housing, then the connecting part of the contact is connected by insulation displacement connection to the electric wire of the first article, and the retainer is fitted onto the housing.

Next, when the housing is fitted onto the first article, and the two articles are arranged in a certain positional relationship and joined together, the contacting part of the contact will contact the conductive part of the second article with a pressing force, and the electric wire and the conductive part will be electrically connected via the contact. Or when the housing is fitted onto the second article, the contacting part of the contact will contact the conductive part of the second article with a pressing force, and the electric wire and the conductive part will be electrically connected together via the contact. Or when the housing is fitted onto both the first article and the second article, the contacting part of the contact will contact the conductive part of the second article with a pressing force, and the electric wire and the conductive part will be electrically connected together via the contact.

In any of the above-mentioned connecting forms, as the contacting part of the contact will contact the conductive part of the second article with a pressing force, a contact pressure at the contacting point will be secured to reliably make an electric connection of the two articles. In this connecting structure, as the number of electric connector to be used is one in contrast with the conventional connecting structure using a pair of a male crimp connector and a female crimp connector, the costs are lowered through the reduction in the number of electric connector in use. As the work of connecting the electric wire to the electric connector, for example, crimping or insulation displacement connection, can be done by a single operation, the costs are lowered through the improved workability. When the housing is fitted onto both the first article and the second article, as the two articles will be joined together via the electric connector, a separate joining means such as a screw is not needed to join the two articles together, and the costs are reduced through the elimination of any joining means. As a single electric connector is used in the connecting structure, the space occupied by the electric connector is reduced in comparison with the conventional connecting structure wherein a pair of a male crimp connector and a female crimp connector are used, and the connecting structure is compactified.

Even if the electric wire is subjected to a pulling and moving force and is bent to lift from the receiving groove, the electric wire will be held by the retainer. Hence the electric wire or the wired contact is prevented from coming off the housing.

Accordingly, the electric connector of the present invention ensures a contact pressure at the contacting point and makes a reliable electric connection between the articles, reduces the number of electric connector in use and improves the workability, and in turn, achieves significant cost reduction and compactification of the connecting structure. Even if the electric wire is subjected to a pulling and moving force and is bent towards the receiving groove, the electric wire will be held by the retainer. Thus the electric wire or the wired contact is reliably prevented from coming off the housing. When the housing is fitted onto both the first article and the second article, the costs can be reduced through elimination of a joining means.

BRIEF DESCRIPTION OF THE DRAWINGS

FIG. 4A is a plan view, FIG. 4B is a front view, and FIG. 4C is a bottom view.

FIG. 6A is a plan view, FIG. 6B is a front view, and FIG. 6C is a side view.

DESCRIPTION OF PREFERRED EMBODIMENTS OF THE INVENTION

Figure 1:
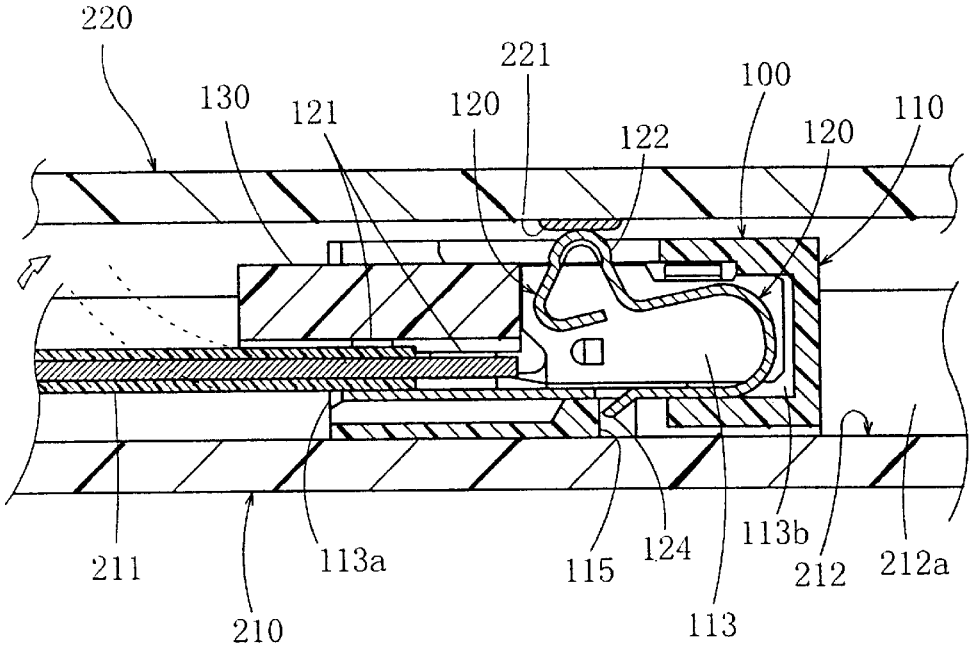
FIG. 1 is a sectional view of the electric connector of the first embodiment when it is used by fitting it onto the first article.
Figure 2:
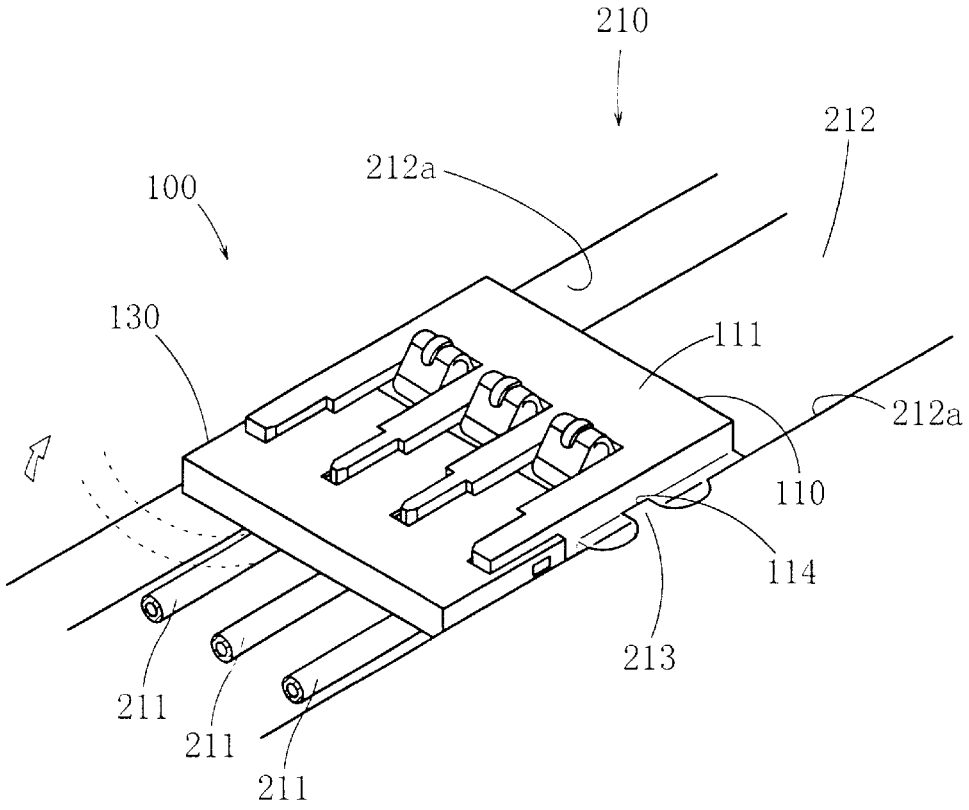
FIG. 2 is a perspective view of the electric connector of the first embodiment when it is used by fitting it onto the first article.
Figure 3:
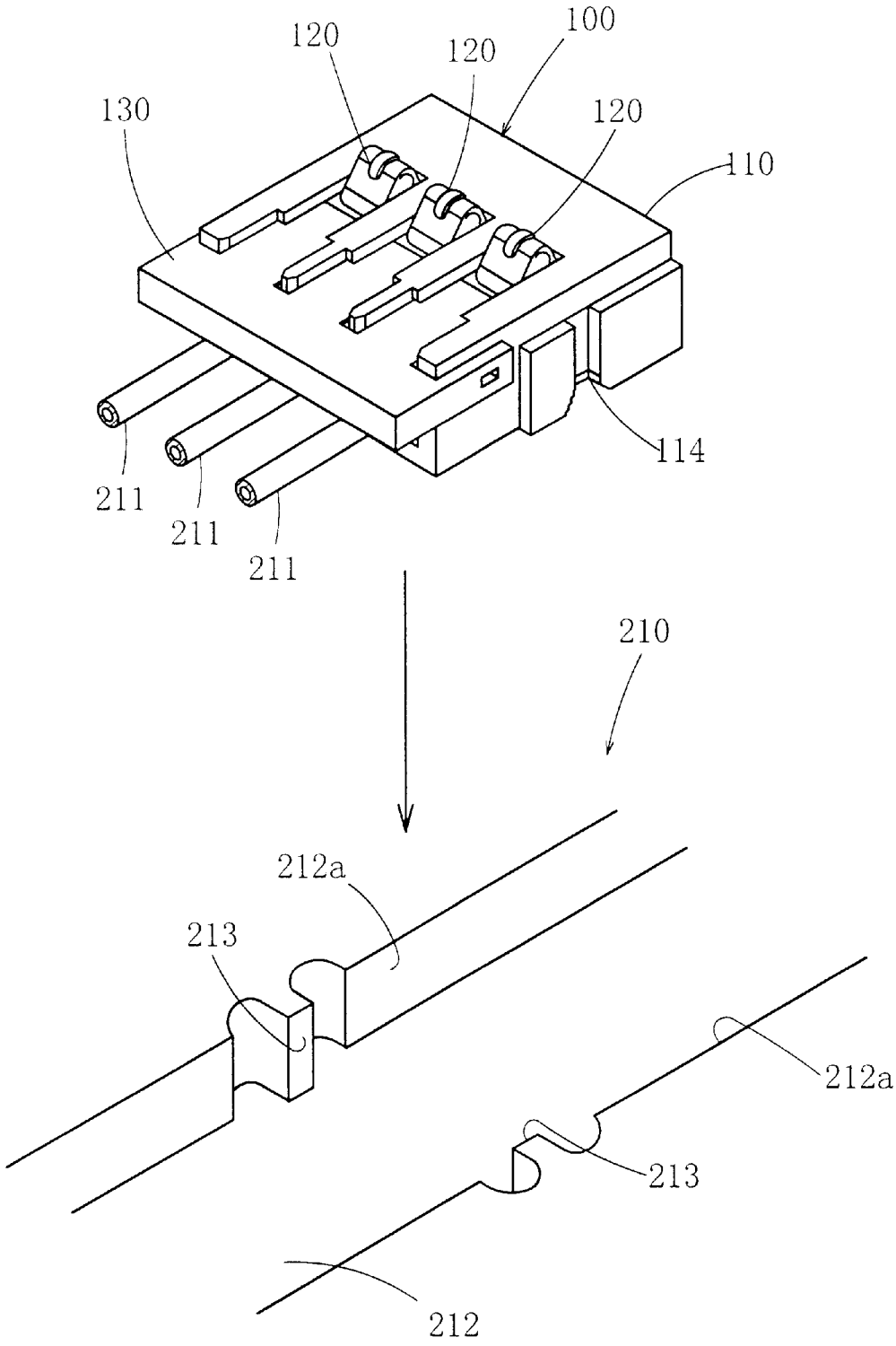
FIG. 3 is a perspective view of the electric connector of the first embodiment when it is fitted onto the first article.

Some embodiments of the electric connector of the present invention will be described below. FIG. 1 through FIG. 3 show the electric connector 100 of the first embodiment. This electric connector 100 is used to electrically connect the electric wire of the first article to the conductive part of the second article. Here, the first article 210 is exemplified by a casing of an electric appliance, and this first article 210 has the electric wire 211. The second article 220 is exemplified by a printed circuit board, and the conductive part 221 of the second article 220 is exemplified by a conductive pad. The concepts of the articles and the concepts of the conductive parts according to the present invention are not limited in any way by these exemplifications. The articles may be any corporeal things, and the conductive parts may be any members having electric conductivity.

Figure 4A:
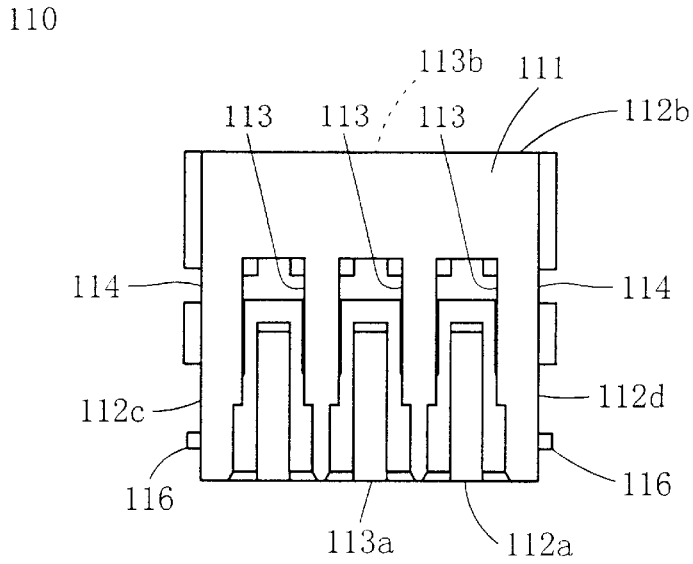
FIG. 4A, FIG. 4B and FIG. 4C show the housing of the electric connector of the first embodiment.
Figure 4B:
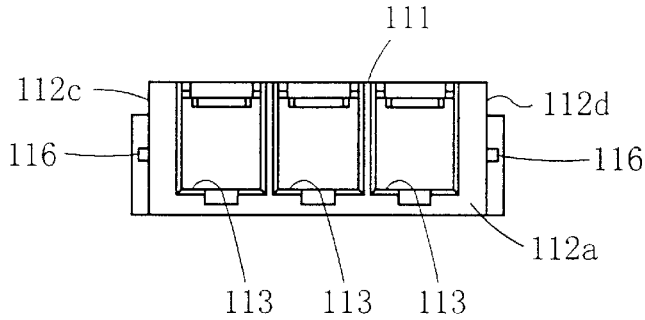
Figure 4C:
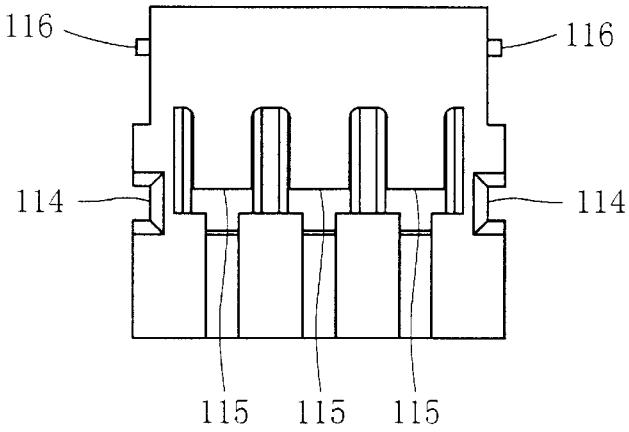

The above-mentioned electric connector 100 comprises a housing 110, which is fitted onto the first article 210, a contact 120, which is inserted into and fitted onto a receiving groove of the housing 110, and a retainer 130, which is fitted onto the housing 110. As shown in FIG. 4A, FIG. 4B and FIG. 4C, the housing 110 is formed approximately into a rectangular parallelepiped. For convenience, a direction along one side of the housing 110 is defined as the longitudinal direction, a direction that is approximately perpendicular to that direction is defined as the width direction, and a direction that is approximately perpendicular to both the longitudinal direction and the width direction is defined as the height direction. The housing 110 has a front face 111, which faces the conductive part 221 of the second article 220 when the electric wire 211 of the first article 210 is electrically connected to the conductive part 221 of the second article 220 via the electric connector 100, and side faces, which extend from the periphery of the front face 111 in the height direction. Since the housing 110 is approximately a rectangular parallelepiped, it has side faces 112*a*, 112*b*, which are on both ends in the longitudinal direction, and side faces 112*c*, 112*d*, which are on both ends in the width direction. The housing 110 is provided with a receiving groove 113, which is recessed into the front face 111 and extends in the longitudinal direction. One end 113*a* of this receiving groove 113 extends to and opens in one side face 112*a*. With this arrangement, the receiving groove 113 has an open side end 113*a* and a closed side end 113*b*, and the receiving groove 113 acquires a directionality that is determined by the open side and the closed side. The same number of receiving grooves 113 as the contacts 120 are formed in a row in the width direction. A fitting groove 114 extending in the height direction is formed in the side faces 112*c*, 112*d* on both ends in the width direction of the housing 110, into which a guide protrusion (that will be described below) of the first article 210 is fitted. The housing according to the present invention is not limited to the form of the approximate rectangular parallelepiped. It may be any form, which can be fitted onto one article and into which the contacts can be assembled.

Figure 5:
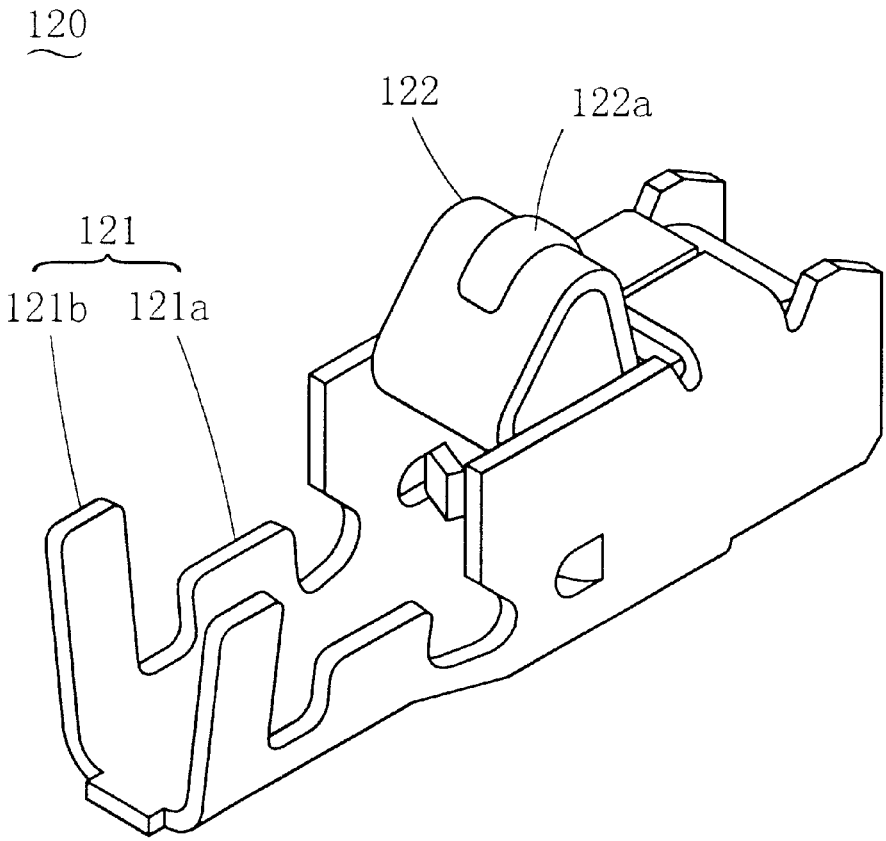
FIG. 5 is a perspective view of the contact of the electric connector of the first embodiment.

As shown in FIG. 5, the above-mentioned contact 120 is made of a member that has electric conductivity. The contact 120 comprises a connecting part 121, which is connected to the conductive part 211 of the first article 210, and a contacting part 122, which contacts the conductive part 221 of the second article 220. Inside the receiving groove 113, the contacting part 122 is arranged closer to the closed side of the receiving groove 113 than the connecting part 121.

The contact 120 is inserted into the receiving groove 113 from the open side thereof. In this embodiment, it is exemplified by a crimp type contact 120. Hence the connecting part 121 is a barrel formed on the contact 120, and this barrel comprises a wire barrel 121*a,* which crimps the core of the electric wire 211, and an insulation barrel 121*b,* which crimps this electric wire together with its insulation. The contacting part 122 is made of an oblong rectangle material, which is curved to form a U-shape when seen in the width direction and function as a leaf spring, which is flexible in the height direction. When necessary, the top end of the contacting part 122 is bent into an inverted-U shape, when seen in the width direction, to form a contacting point, and this contacting point comes out of the receiving groove 113 of the housing 110 and the front face 111 thereof. The configuration of the contact is not limited by this embodiment. The contact may be bent into, for example, an L shape without any curving. When necessary, a dimple 122*a* is formed in this contacting part 122 by embossing or the like to define a contacting point for the conductive part 221 of the second article 220. In this embodiment, a fitting structure with the so-called contact lance is used. In other words, the contact 120 is provided with a protruding piece 124, and this protruding piece 124 is used as a lance to be fitted into a fitting window 115 that is opened in the receiving groove 113 of the housing 110. In contrast with this, a fitting structure with the so-called housing lance may be used. In that case, the housing is provided with a protruding piece and this protruding piece is fitted into a fitting window of the contact. The contact may be fitted into the housing without using any lance.

Figure 6A:
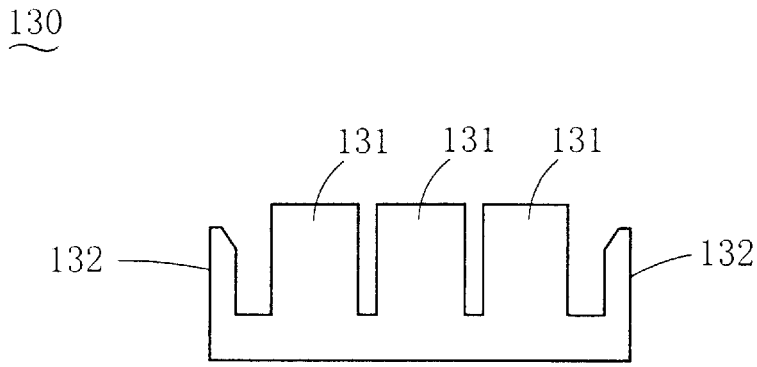
FIG. 6A, FIG. 6B and FIG. 6C show the retainer of the electric connector of the first embodiment.
Figure 6B:
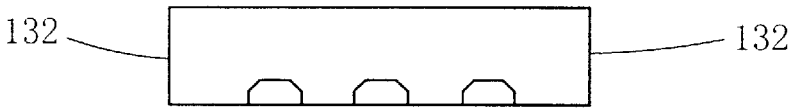
Figure 6C:
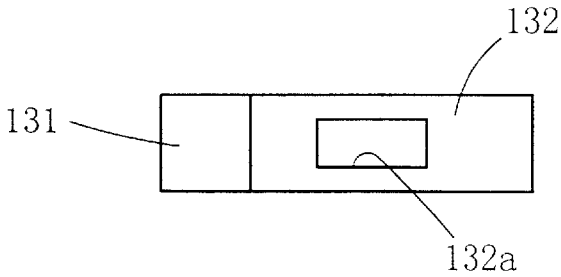
Figure 7:
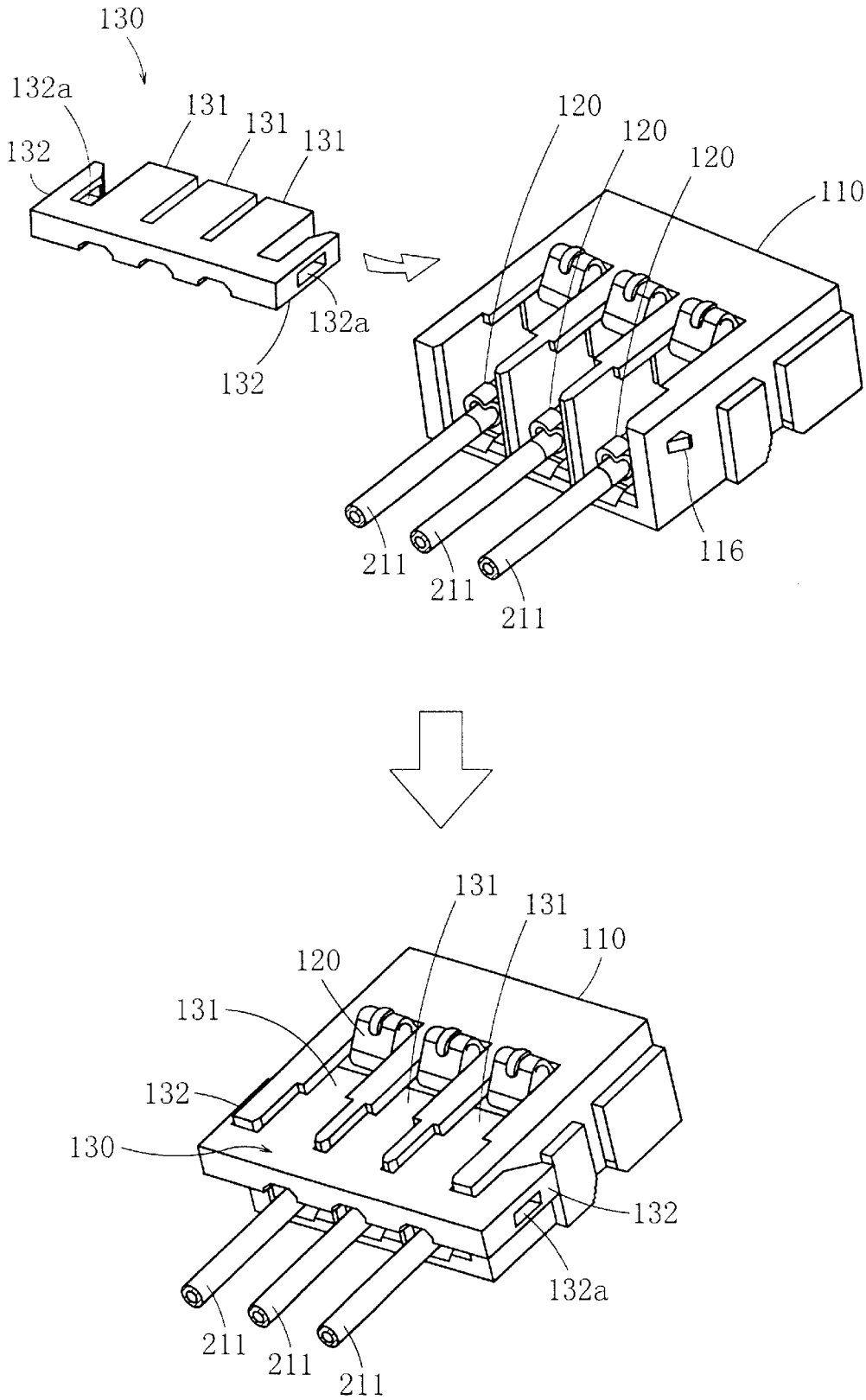
FIG. 7 is a perspective view that illustrates fitting of the retainer onto the housing of the electric connector of the first embodiment.

As shown in FIG. 6A, FIG. 6B and FIG. 6C, the retainer 130 is fitted onto the housing 110, the retainer 130 covering at least the open-side ends 113*a* of the receiving grooves 113. The retainer 130 comprises covers 131, which fit into the receiving grooves 113, and arms 132, which fit onto the housing 110. In this embodiment, the cover 131 is formed into a comb so that it can fit into the respective receiving grooves 113. The arm 132 is formed into an Lshape, and one end of the arm 132 is connected to the cover 131 and the arm 132 extends along the side face of the housing 110. Either one of the arm 132 and the housing side face is provided with a fitting pawl, and the other one is provided with a receiving cavity or recess part that fits together with the fitting pawl. In this embodiment, two arms 132 are provided along both ends, in the width direction, of the cover 131, and the arms 132 extend backward along the side faces 112*c*, 112*d* in the longitudinal direction of the housing 110. Each of the side faces 112*c*, 112*d* of the housing 110 is provided with a fitting pawl 116, and each of the arms 132 is provided with a fitting cavity or recess part 132*a* that fits together with the fitting pawl 116. With this arrangement, as shown in FIG. 7, when the connecting parts 121 of the contacts 120 are connected to the electric wires 211 of the first article 210 by crimping, and these wired contacts 120 are fitted onto the receiving grooves 113 of the housing 110, if the retainer 130 is pushed into the receiving grooves 113 from their open side towards their closed side, the covers 131 will fit into the receiving grooves 113, the arms 132 will advance along the side faces 112*c*, 112*d* of the housing 110, and the retainer 130 will be fitted onto the housing 110 by engagement between the fitting pawls and the fitting cavity or recess parts.

The above-mentioned housing 110 is fitted onto an article by fitting itself into a concaved part formed in the article. In the case of the connecting form shown in FIG. 1 through FIG. 3, the housing 110 is fitted onto the first article 210. To this end, a groove-shaped recessed part 212 is formed in the first article 210, and the width of the housing 110 is made to have a dimension that can fit into this recessed part 212. The electric connector 100 is fitted into this recessed part 212 in such a way that the height direction of the electric connector 100 aligns with the depth direction of the recessed part 212 and the contacting part 122 comes out of the recessed part 212. On each of the two longitudinal walls 212*a* of this recessed part 212, which are opposing to each other, a guide protrusion 213 is formed to extend in the depth direction. In each of both the side faces 112*c*, 112*d*, in the width direction, of the housing 110, a fitting groove 114, into which the abovementioned guide protrusion 213 fits, is formed to extend in the height direction. The fitting grooves 114 and the guide protrusions 213 fit together with a certain pressure, and the housing 110 is fitted onto the first article 210 by this fitting (the state shown in FIG. 1 and FIG. 2). Here, fitting grooves 114 are formed in the electric connector 100 and guide protrusions 213 are formed on the recessed part 212. However, in contrast with this, guide protrusions may be formed on the electric connector and fitting grooves may be formed in the recessed part. Here, the recessed part 212 is groove-shaped, but the recessed part may have any form provided that it can receive the electric connector. Moreover, instead of providing fitting grooves and guide protrusions, the side faces of the housing may be made to face-contact the longitudinal walls of the recessed part and the housing may be fitted onto the first article by this fitting. These comments also apply to the recessed parts 212, 225, which will be described in relation to the connecting forms that will be described below.

The operation of the first embodiment will be described below. The connecting part 121 of the contact 120 of this electric connector 100 is connected to the electric wire 211 of the first article 210 by crimping. Then the contact 120 is inserted into and fitted onto the receiving groove 113 of the housing 110. Then the retainer 130 is fitted onto the housing 110.

Next, in the case of the connecting form shown in FIG. 1 through FIG. 3, when the housing 110 is fitted onto the first article 210 and the two articles 210, 220 are arranged in a certain positional relationship and joined together by screwing, etc., the contacting part 122 of the contact 120 will contact the conductive part 221 of the second article 220 with a pressing force and the electric wire 211 and the conductive part 221 will be electrically connected together via the contact 120.

Figure 8:
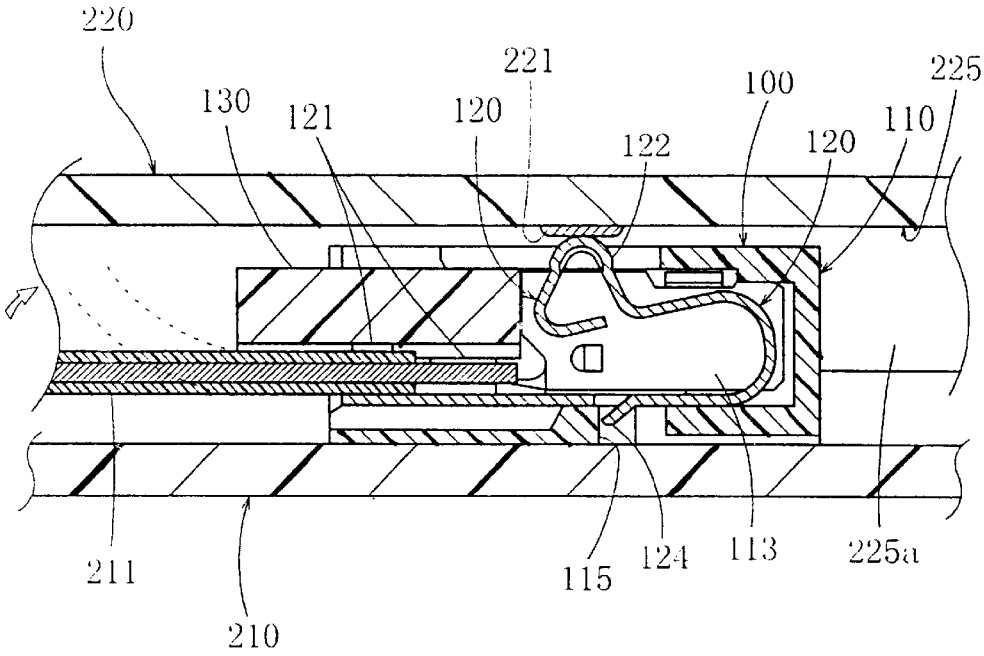
FIG. 8 is a sectional view of the electric connector of the first embodiment when the electric connector is used by fitting it onto the second article.
Figure 9:
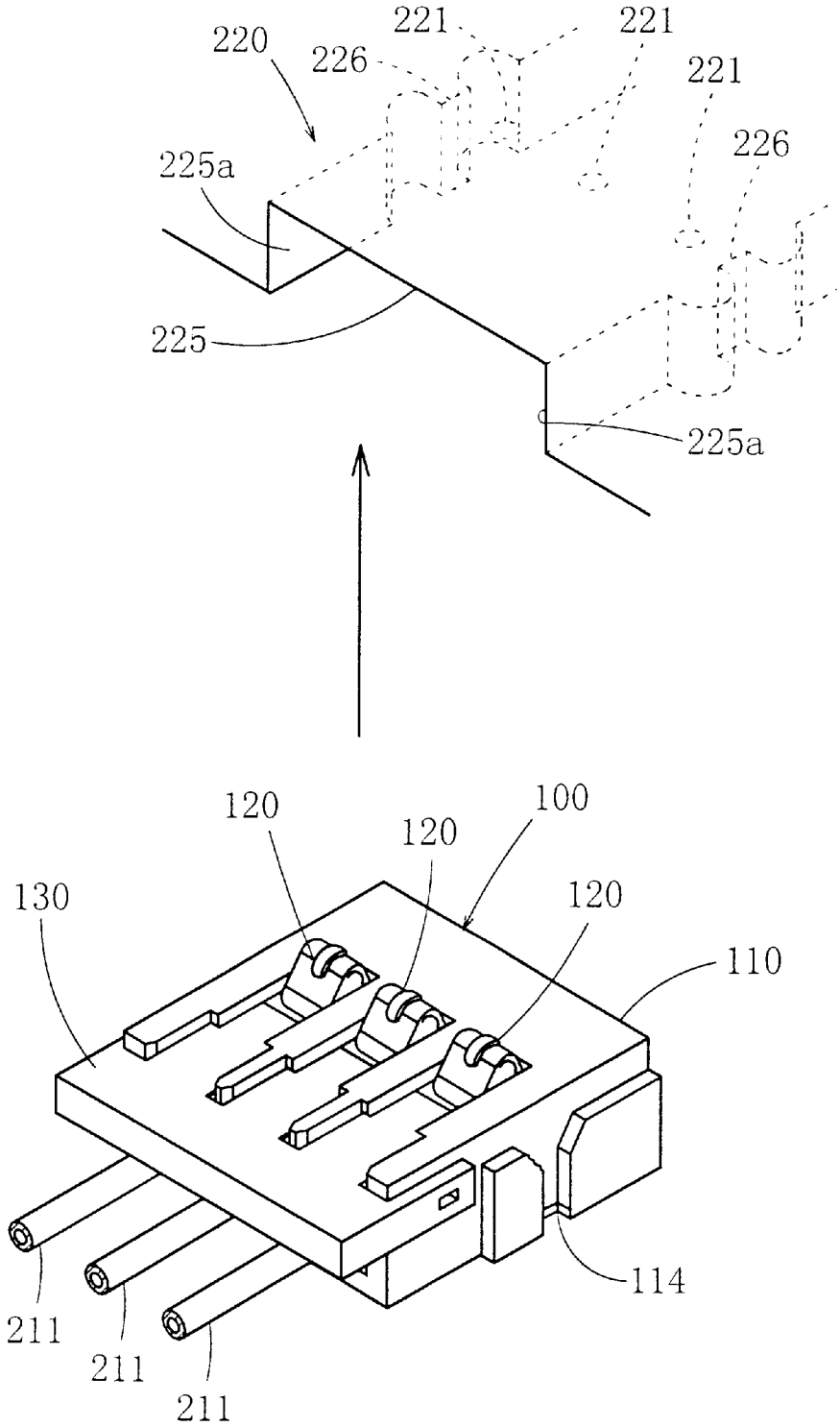
FIG. 9 is a perspective view of the electric connector of the first embodiment when it is fitted onto the second article.

FIG. 8 and FIG. 9 show another connecting form of the electric connector 100 of the above-mentioned first embodiment. In this case, the housing 110 is fitted onto the second article 220. To this end, a groove-shaped concaved or recessed part 225 is formed in the second article 220, and the width of the housing 110 is made to have a dimension that can fit into this recessed part 225. The conductive part 221 of the second article 220 is provided on the bottom of the recessed part 225. The electric connector 100 is fitted into this recessed part 225 in such a way that the height direction of the electric connector 100 aligns with the depth direction of the recessed part 225 and the contacting part 122 is opposed to the bottom of the recessed part 225. On each of the two longitudinal walls 225*a* of this recessed part 225, which are opposed to each other, a guide protrusion 226, which fits into a fitting groove 114 of the housing 110, is formed in the depth direction. These fitting grooves 114 and the guide protrusions 226 fit together with a certain pressure, and the housing 110 is fitted onto the second article 220 by this fitting.

In the case of this connecting form, when the connecting part 121 of the contact 120 of the electric connector 100 is connected to the electric wire 211 of the first article 210, and the housing 110 is fitted onto the second article 220, the contacting part 122 of the contact 120 will contact the conductive part 221 of the second article 220 with a pressing force, and the electric wire 211 and the conductive part 221 will be electrically connected via the contact 120.

Figure 10:
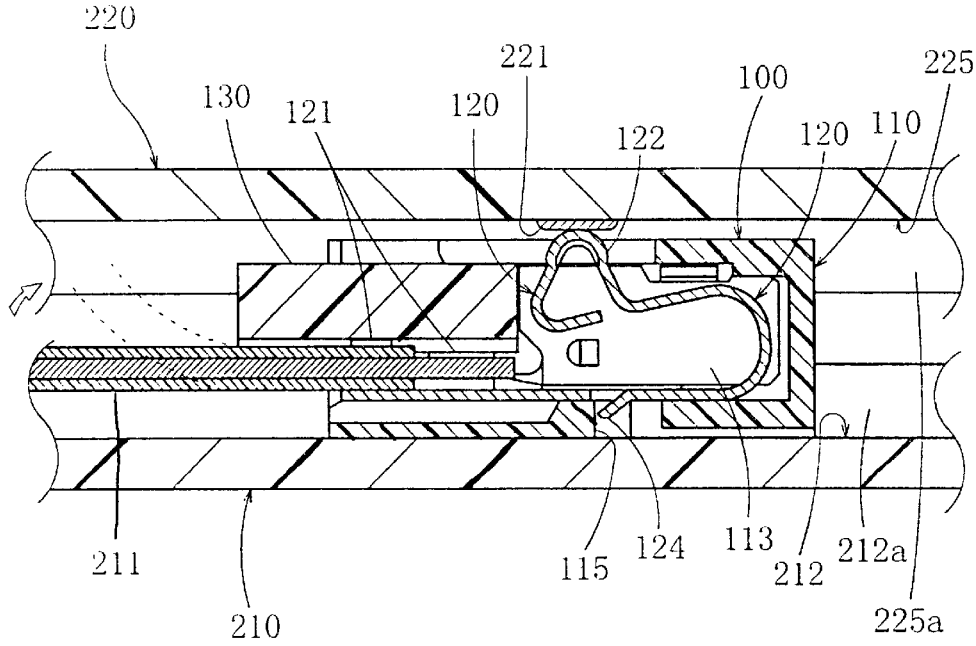
FIG. 10 is a sectional view of the electric connector of the first embodiment when it is fitted onto both the first article and the second article.

FIG. 10 shows another connecting form of the electric connector 100 of the abovementioned first embodiment. In this case, the housing 110 is fitted onto the first article 210 and the second article 220. To this end, a groove-shaped recessed part 212 is formed in the first article 210, and a grooveshaped recessed part 225 is formed in the second article 220, respectively, and the width of the housing 110 is made to have a dimension that can be fitted into both the recessed parts 212, 225. The conductive part 221 of the second article 220 is provided on the bottom of the recessed part 225. The electric connector 100 is fitted into the recessed part 212 in such a way that the height direction of the electric connector 100 aligns with the depth direction of the recessed part 212 and the contacting part 122 comes out of the recessed part 212, and the electric connector 100 is fitted into the recessed part 225 in such a way that the height direction of the electric connector 100 aligns with the depth direction of the recessed part 225 and the contacting part 122 is opposed to the bottom of the recessed part 225. Guide protrusions 213, 226 are formed on the recessed parts 212, 225, and the fitting grooves 114 and the guide protrusions 213, 226 are fitted together with a certain pressure, and the housing 110 is fitted onto both the first article 210 and the second article 220 by this fitting.

In the case of this connecting form, when the connecting part 121 of the contact 120 of the electric connector 100 is connected to the electric wire 211 of the first article 210 and the housing 110 is fitted onto both the first article 210 and the second article 220, the contacting part 122 of the contact 120 will contact the conductive part 221 of the second article 220 with a pressing force, and the electric wire 211 and the conductive part 221 will be electrically connected by the contact 120.

In any of the above-mentioned connecting forms, as the contacting part 122 of the contact 120 contacts the conductive part 221 of the second article 220 with a pressing force, the electric connection between the articles 210, 220 is made reliably by securing a contact pressure at the contacting point. In this connecting structure the number of electric connector used is one in contrast with the conventional connecting structure wherein a pair of a male crimp connector and a female crimp connector are used. Accordingly, the costs are reduced through the reduction in the number of electric connectors used. As the work of connecting the electric wire 211 to the electric connector 100 by crimping or insulation displacement connection can be done by one operation, the costs are reduced through improvement in the workability. When the housing 110 is fitted onto both the first article 210 and the second article 220, as the two articles 210, 220 are joined together by the electric connector 100, there is no need of independently joining the two articles 210, 220 by a joining means such as screws. Hence costs are reduced through elimination of a joining means. As only one electric connector 100 is used in the connecting structure, in contrast with the conventional connecting structure using a pair of a male crimp connector and a female crimp connector, the space occupied by the electric connector is smaller and the connecting structure is more compact.

In that case, at the stage of fitting the electric connector 100 onto the articles 210, 220 or after the fitting, as shown in FIG. 1 and FIG. 2, FIG. 8 and FIG. 10 by dashed lines, even if the electric wire 211 is subjected to a pulling and moving force in the direction of the arrow and bends to lift from the receiving groove 113, the electric wire 211 will be held by the retainer 130. Thus the electric wire 211 or the wired contact 120 will be prevented from coming off the housing 110.

The retainer 130 of the present invention may be any one, which covers at least the open side ends 113*a* of the receiving grooves 113 and is fitted onto the housing. Then the electric wires will be held by the retainer and the electric wires, etc. will be prevented from coming off the housing. However, as is the case of the above-mentioned embodiment, if the retainer 130 comprises covers 131, which fit into the receiving grooves 113, and the arms 132, which fit onto the housing 110, the retainer 130 can be easily fitted onto the housing 110 by a single touch.

The present invention includes any forms of structure for fitting the housing of the electric connector onto an article. However, as is the case of the abovementioned embodiment, if the housing 110 is formed to be fitted into the recessed part 212 of the article 210 and/or the recessed part 225 of the article 220, whereby the housing 110 is fitted onto the article 210 and/or the article 220 by this fittingin, then the procedure of fitting the electric connector 100 into the recessed part 212 of the article 210 and/or the recessed part 225 of the article 220 will fit the electric connector 100 onto the article 210 and/or the article 220. Hence the workability of fitting is improved.

In the following, other embodiments will be described. As the basic description of these other embodiments, the description of the first embodiment will be referenced and will apply in its entirety with the same reference characters. Then configurations differing from the first embodiment will be described additionally.

Figure 11:
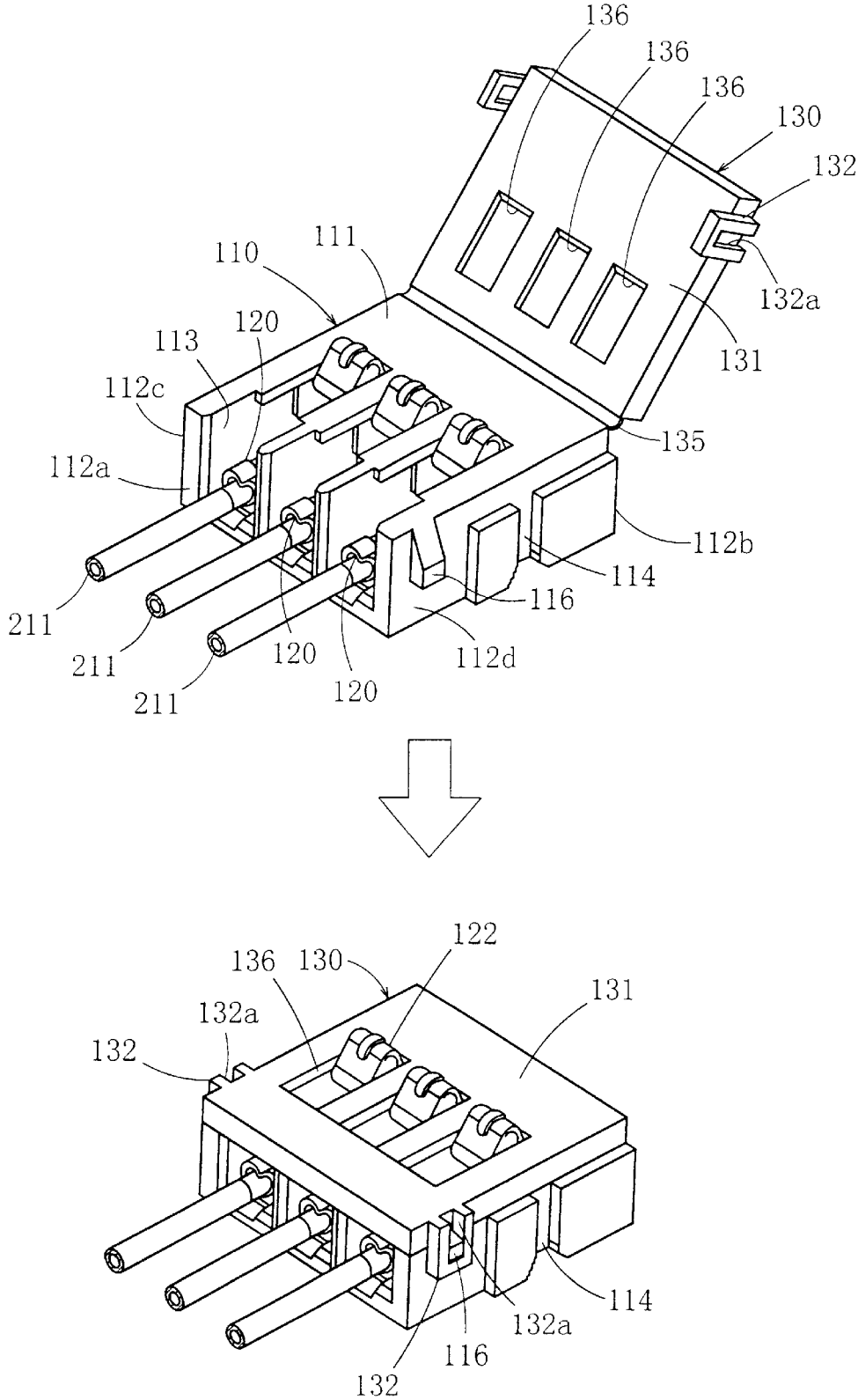
FIG. 11 is a perspective view that illustrates fitting of the retainer onto the housing of the electric connector of the second embodiment.

FIG. 11 shows the second embodiment. The electric connector 100 of the second embodiment differs from the first embodiment in the configuration of the retainer. The retainer 130 comprises a plateshaped cover 131 and arms 132, which fit this cover 131 onto the housing 110. The cover 131 covers the front face 111 of the housing and is rotatably joined to the housing at one end thereof. Windows 136 are formed in the cover 131 to allow the contacting parts 122 of the contacts 120 to come out therethrough. In this embodiment, the retainer 130 is joined to the rear end of the front face 111 of the housing 110 by a thin part 135, but the retainer 130 may be joined, for example, by a hinge. The arms 132 extend along the side faces 112*c*, 112*d* of the housing 110 from the cover 131. Fitting pawls are provided on either the arms 132 or the housing side walls 112*c*, 112*d*, and fitting cavity or recess parts, which fit with the fitting pawls, are provided on the other. In this embodiment, two arms 132 are provided on both ends, in the width direction, of the cover 131, and they extend along the side faces 112*c*, 112*d*, in the height direction, of the housing 110, respectively. Fitting pawls 116 are provided on the side faces 112*c*, 112*d* of the housing 110, and fitting cavity or recess parts 132*a*, which fit with the fitting pawls 116, are provided in the arms 132.

With the arrangements of the second embodiment, as shown in the upper diagram of FIG. 11, the cover 131 is rotated in a direction to move away from the front face 111 of the housing 110, then contacts 120, which have been crimp-connected to electric wires 211 of the first article 210, are inserted into the receiving grooves 113 of the housing 110. Next, the cover 131 is rotated to cover the front face 111 of the housing 110. As a result, the retainer 130 is fitted onto the housing 110 by the fitting between the fitting pawls 116 and the fitting cavity or recess parts 132*a*. Thus the retainer 130 can be easily fitted on the housing 110 with a single touch, and moreover, as the retainer 130 is joined to the housing 110, the number of parts is reduced and this is advantageous from the viewpoint of management.

Figure 12:
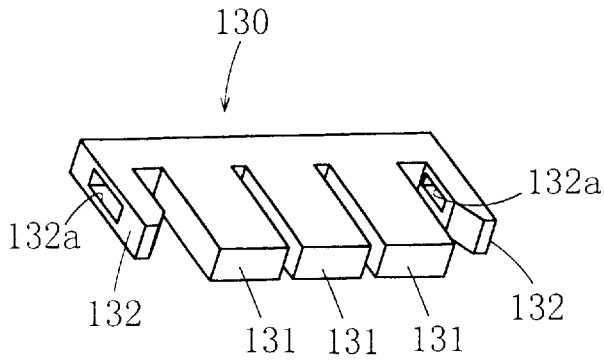
FIG. 12 is a perspective view of the electric connector of the third embodiment when it is fitted onto the first article.
Figure 12:
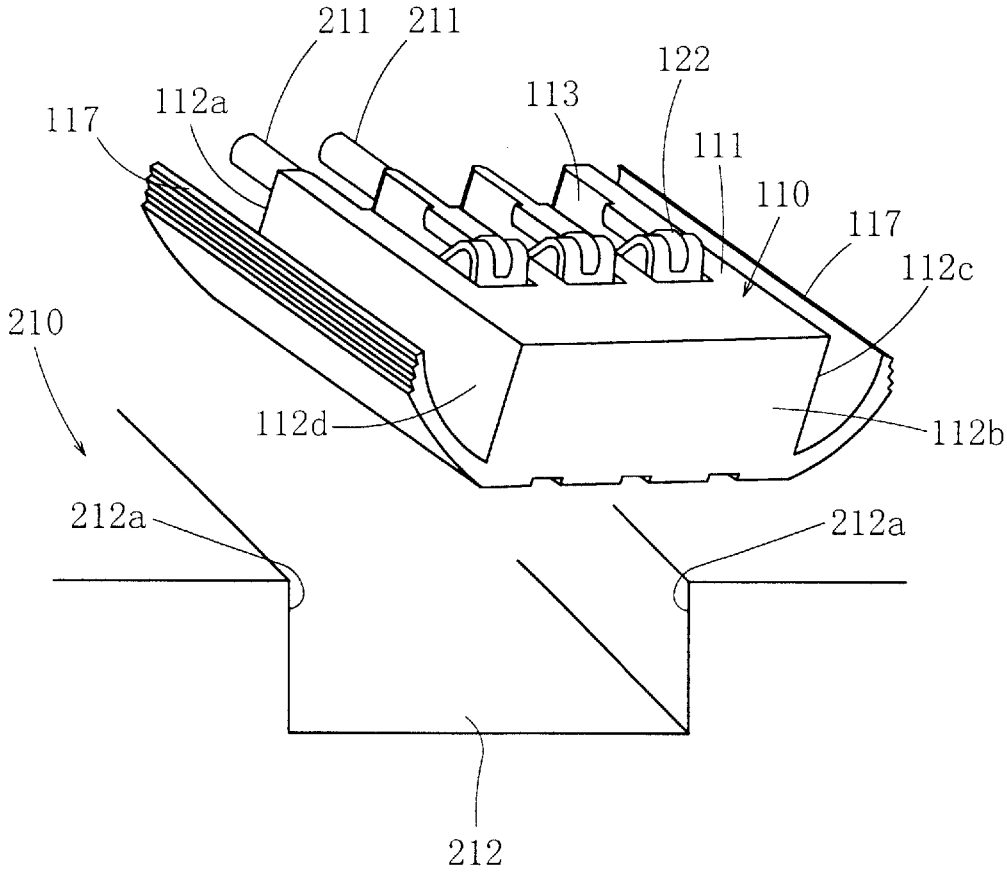
Figure 13:
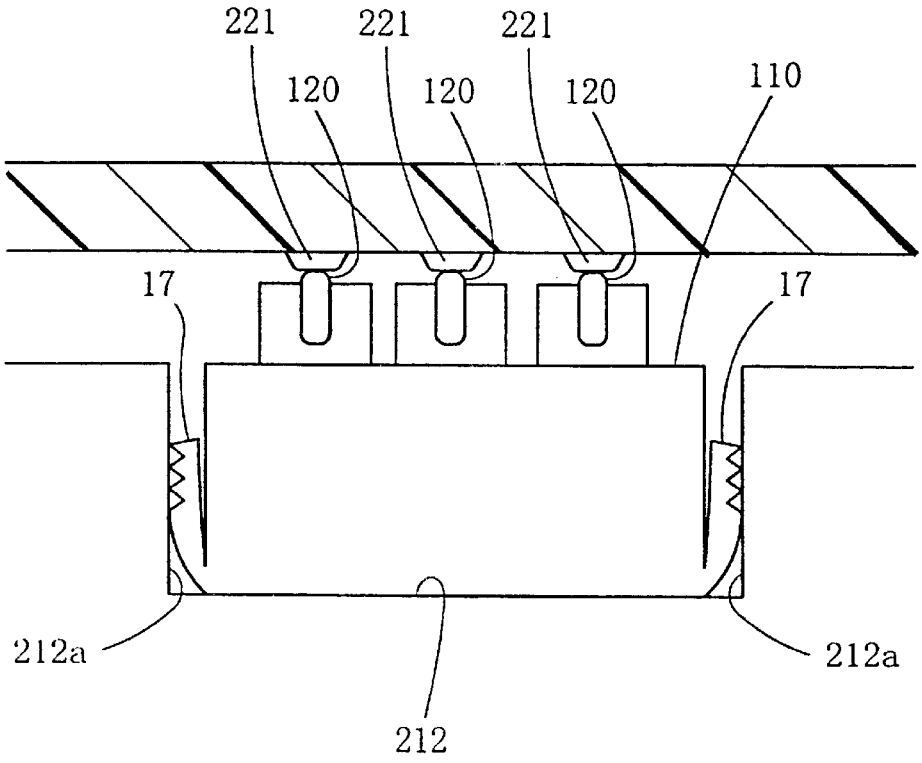
FIG. 13 is a front view of the electric connector of the third embodiment when it is used by fitting it onto the first article.

FIG. 12 and FIG. 13 show the electric connector 100 of the third embodiment. The housing 110 of the electric connector 100 of this third embodiment is formed in such a way that it can be inserted into a recessed part formed in an article and is provided with wings 117, which are elastically deformed to press against the longitudinal walls of a recessed part when the housing 110 is inserted into the recessed part. The housing 110 is fitted onto the article by the pressures of the wings 117. In this embodiment, a wing 117 is provided on each of two side faces 112*c*, 112*d* on both ends, in the width direction, of the housing 110. The fitting form of the retainer 130 onto the housing 110 may be any form of the first embodiment and the second embodiment. In the case of the connecting form shown in FIG. 12 and FIG. 13, the housing 110 is fitted onto the first article 210. To this end, a recessed part 212 is formed in the first article 210 and the housing 110 is formed in such a way that it can be inserted into the recessed part 212, and the housing 110 is provided with wings 117, which are elastically deformed to press against the longitudinal walls 212*a* of the recessed part 212 when the housing 110 is inserted into the recessed part 212. The electric connector 100 is fitted into this recessed part 212 in such a way that the height direction of the electric connector 100 aligns with the depth direction of the recessed part 212 and the contacting parts 122 come out of the recessed part 212. The method of electrically connecting the articles 210, 220 with the electric connector 100 in this connecting form is similar to that of the connecting form shown in FIG. 1 through FIG. 3.

Figure 14:
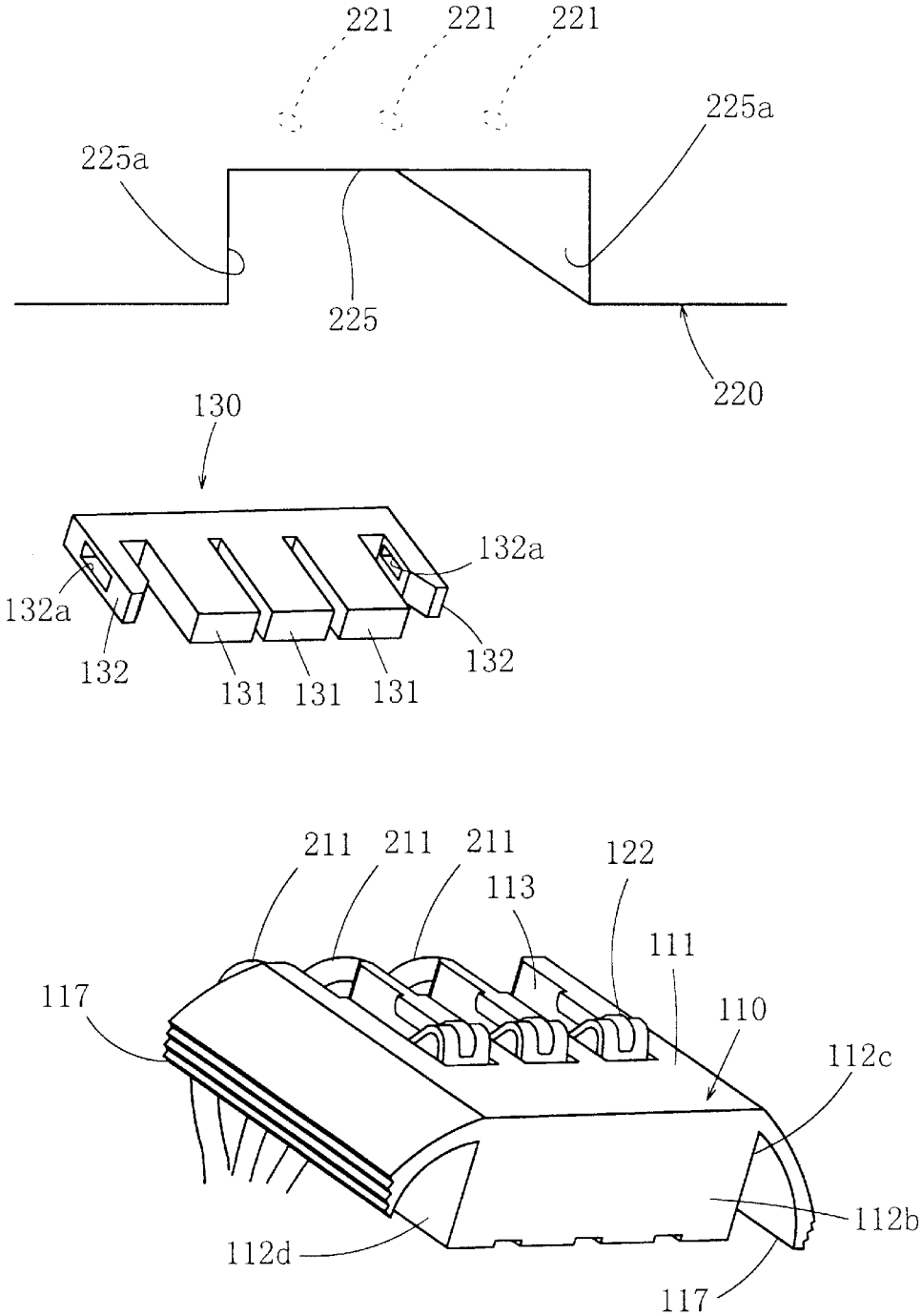
FIG. 14 is a perspective view of the electric connector of the third embodiment when it is fitted onto the second article.

FIG. 14 shows another connecting form of the electric connector 100 of the above-mentioned third embodiment. In the case of this connecting form, the housing 110 is fitted onto the second article 220. To this end, a recessed part 225 is formed in the second article 220, and the housing 110 is formed in such a way that it can be inserted into the recessed part 225 and is provided with wings 117, which are elastically deformed to press against the longitudinal walls 225*a* of the recessed part 225 when the housing 110 is inserted into the recessed part 225. The electric connector 100 is fitted into this recessed part 225 in such a way that the height direction of the electric connector 100 aligns with the depth direction of the recessed part 225 and the contacting part 122 is opposed to the bottom of the recessed part 225. The method of electrically connecting the articles 210, 220 with the electric connector 100 in this connecting form is similar to that of the connecting form shown in FIG. 8 and FIG. 9.

The third embodiment in each connecting form can exhibit operation and effect similar to those of the first embodiment, and the third embodiment provides a high fitting force with a simple construction. Moreover, dimensional errors, which occur in the internal dimensions of the recessed parts 212, 225, are absorbed by deflections of the wings 117, and in turn, the yields of the articles 210, 220 and the electric connector 100 are improved. When the wings 117 are provided on both ends, in the width direction, of the housing 110, the elastic restoring forces of the wings 117 will work on both the ends, in the width direction, of the housing 110 and, in turn, after fitting, the electric connector 100 will be held stably on the article 210, 220. This is preferable.

Figure 15:
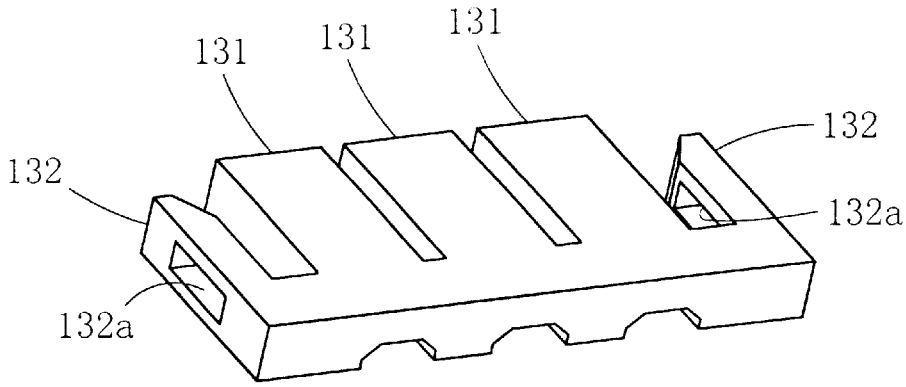
FIG. 15 is a perspective view of the electric connector of the fourth embodiment.
Figure 15:
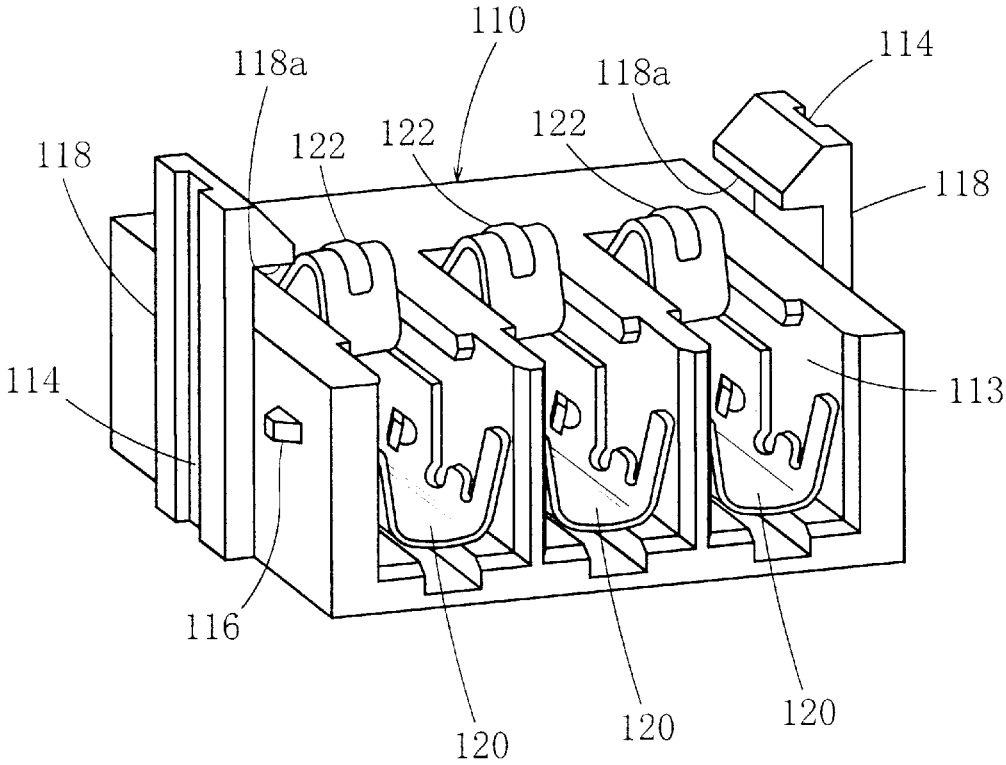
Figure 16:
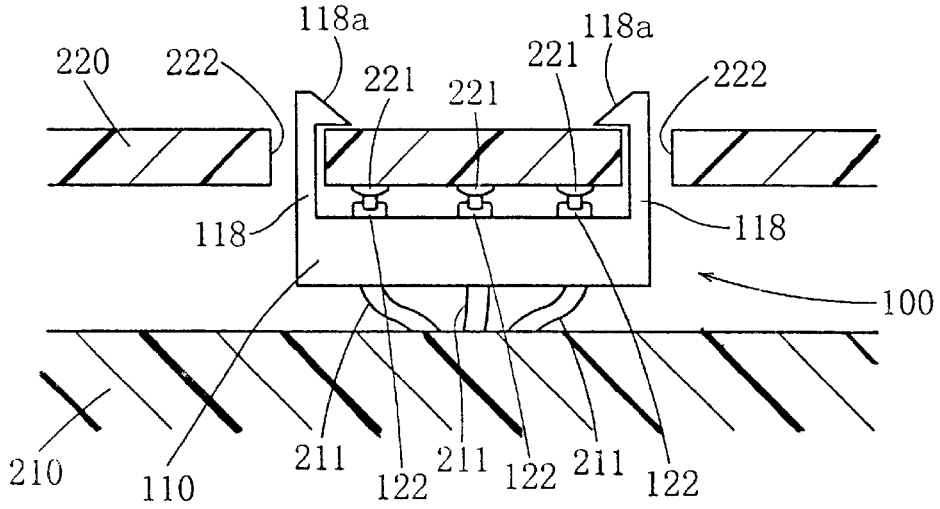
FIG. 16 is a front view of the electric connector of the fourth embodiment when it is used by fitting it onto the second article.

FIG. 15 shows the electric connector 100 of the fourth embodiment. In the electric connector 100 of this fourth embodiment, the housing 110 is provided with locking pawls 118, and the housing 100 is fitted onto an article by fitting the locking pawls 118 onto the article. In the case of this embodiment, the locking pawls 118 extend on both ends, in the width direction, of the housing 110 in the direction of height. A hook 118*a* is provided on the top end of each locking pawl 118, and this hook 118*a* enters a locking hole formed in an article and hooks on the edge of the locking hole. The fitting form of the retainer 130 onto the housing 110 may be any fitting form of the first embodiment and the second embodiment. In the case of the connecting form shown in FIG. 16, the housing 110 is fitted onto the second article 220. To this end, locking holes 222 are formed in the second article 220, and the locking pawls 118 extend protrusively from the face of the housing 110, on which the contacting parts 122 are exposed. The electric connector 100 is held in such a way that the contacting parts 122 oppose to the conductive parts 221 of the second article 220, and the locking pawls 118 are fitted on the second article 220. The method of electrically connecting the articles 210, 220 with the electric connector 100 in this connecting form is similar to that of the connecting form shown in FIG. 8 and FIG. 9.

Figure 17:
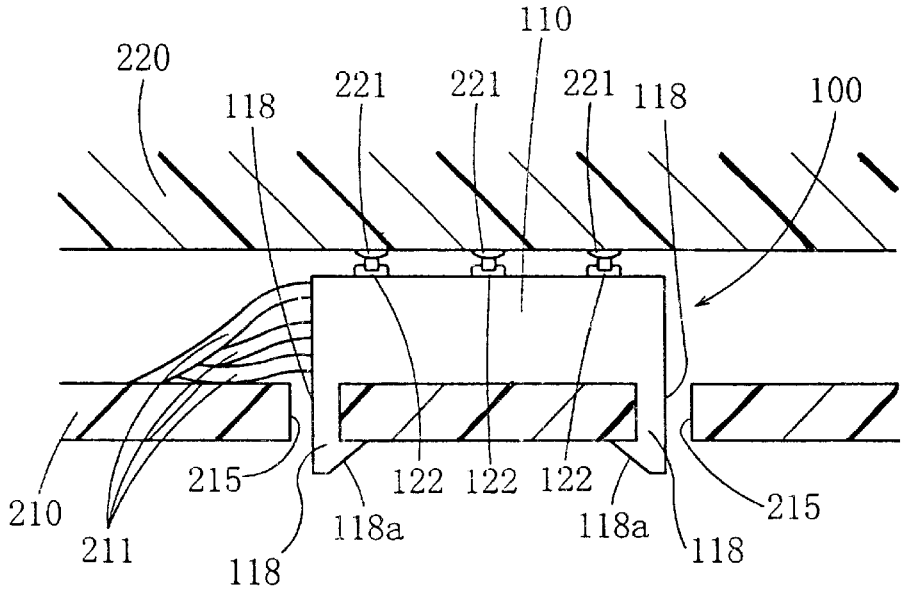
FIG. 17 is a front view of the electric connector of the fourth embodiment when it is used by fitting it onto the first article.

FIG. 17 shows another connecting form of the electric connector 100 of the above-mentioned fourth embodiment. In the case of this connecting form, the housing 100 is fitted onto the first article 210. To this end, locking holes 215 are formed in the first article 210, and the locking pawls 118 extend protrusively from the face of the housing 110, which is opposite, in the height direction, to the face on which the contacting parts 122 are exposed. The electric connector 100 is held in such a way that the face being opposite, in the height direction, to the contacting parts 122 opposes to the first article 210, and the locking pawls 118 are fitted onto the first article 210. The method of electrically connecting the articles 210, 220 with the electric connector 100 in this connecting form is similar to that of the connecting form shown in FIG. 1 through FIG. 3.

The fourth embodiment in each connecting form exhibits operation and effect similar to those of the first embodiment, and high fitting force is provided by a simple structure. When the locking pawls 118 are provided on both ends, in the width direction, of the housing 110, the fitting forces of the locking pawls 118 will work on both ends, in the width direction, of the housing 110, and, in turn, the electric connector 100 will be held stably on both the articles 210, 220 after fitting, and this is preferable.

Figure 18:
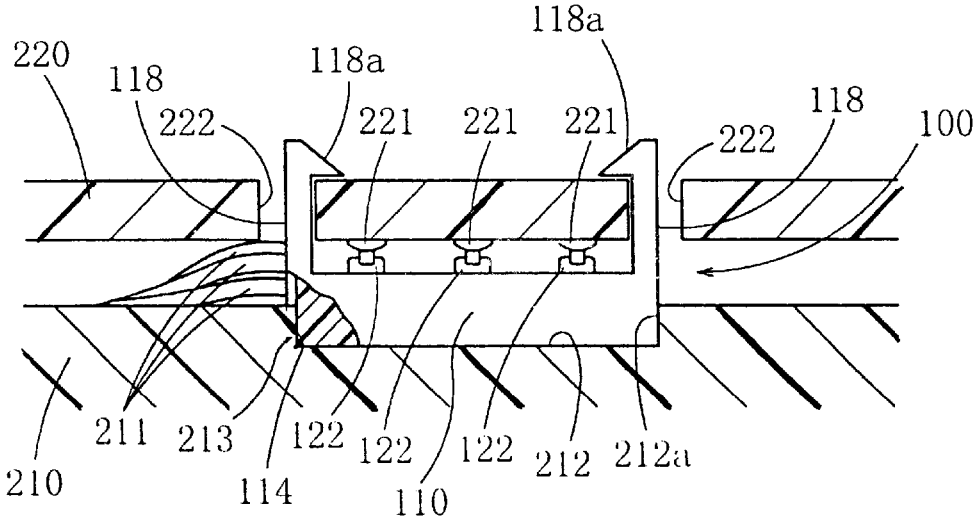
FIG. 18 is a front view of the electric connector of the fourth embodiment when it is used by fitting it onto both the first article and the second article.

The present invention includes all embodiments wherein features of the embodiments described above are combined. The fitting forms of the first embodiment, the fitting forms of the third embodiment, and the fitting forms of the fourth embodiment can be combined in the form of fitting one housing 110 onto both the first article 210 and the second article 220, and the present invention includes all of these embodiments. One example shown in FIG. 18 is an embodiment wherein one housing 110 is fitted onto the first article 210 by the fitting form of the first embodiment and onto the second article 220 by the fitting form of the fourth embodiment. In the case of this embodiment, as shown in FIG. 15, when necessary, a fitting groove 114 is provided in the outside face of each locking pawl 118 and guiding protrusions 213 are provided on the first article 210. In this way, the fittingin force between the housing 110 and the recessed part 212 can be increased. When this form of fitting one housing 110 onto both the first article 210 and the second article 220 is used, as explained in relation to the first embodiment, in addition to the operation and effect that are obtained by the form of fitting one housing 110 onto the first article 210 or the second article 220, the two articles 210, 220 are joined together by the electric connector 100. Hence there will be no need of separately joining the two articles 210, 220 by a joining means such as screws. Thus the costs are reduced through the elimination of a joining means.

Figure 19:
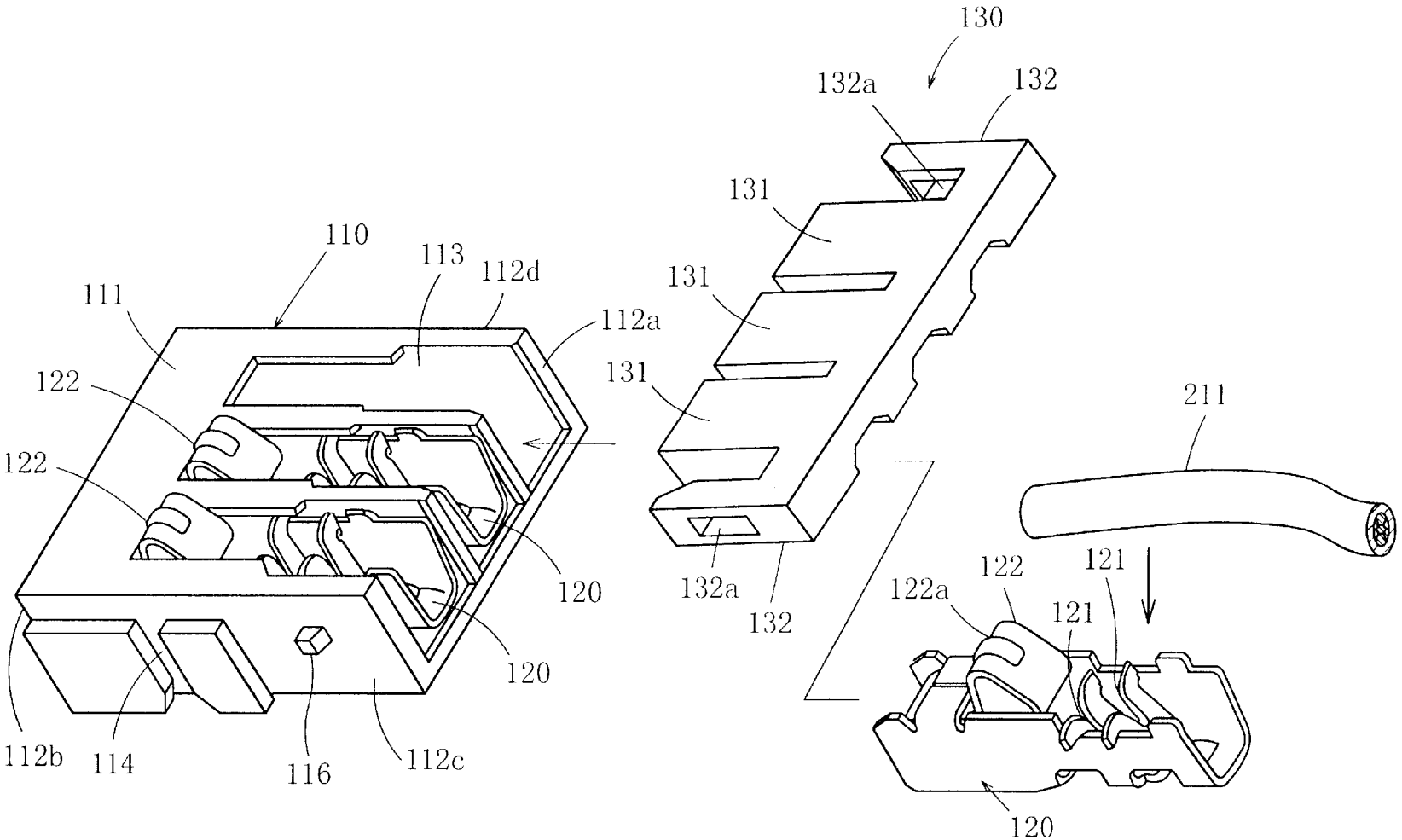
FIG. 19 is a perspective view of the disassembled electric connector of the fifth embodiment.

FIG. 19 shows the fifth embodiment. The fifth embodiment is applicable to any of the above-mentioned embodiments. The electric connector 100 of this fifth embodiment differs from the electric connectors 100 of the first embodiment through the fourth embodiment in that the contact 120 is of the insulation displacement connection type, and is identical to them in other aspects of the construction. Accordingly, the connecting part 121 is a slot that is formed in one end, in the longitudinal direction, of the contact 120. The core of the electric wire 211 of the first article 210 is connected into this slot by insulation displacement connection.

In the fifth embodiment, when the contact 120 of the electric connector 100 is to be connected to the electric wire 211 of the first article 210, the slot being the connecting part 121 of the contact 120 is connected to the electric wire 211 by insulation displacement connection. In other words, when the contact 120 of the first embodiment is of the insulation displacement connection type, the contact 120 of the electric connector 100 is inserted into and fitted onto the receiving groove 113 of the housing 110, then the slot (connecting part) 121 of the contact 120 is connected to the electric wire 211 of the first article by insulation displacement connection, and the retainer 130 is fitted onto the housing 110. Next, the wired electric connector 100 is fitted onto the first article 210 and/or the second article 220, and the contacting part 122 of the contact 120 is made to contact the conductive part 221 of the second article 220 with a pressing force, the electric wire 211 of the first article 210 will be electrically connected to the conductive part 221 of the second article 220 via the contact 120. Furthermore, when the contact 120 of the second embodiment is of the insulation displacement connection type, the cover 131 is rotated to move away from the front face 111 of the housing 110, the electric wire 211 of the first article 210 is connected, by insulation displacement connection, to the slot (connecting part) 121 of the contact 120 received in the receiving groove 113, and then the cover 131 is rotated to cover the front face 111 of the housing 110, the retainer 130 will be fitted onto the housing 110 by fitting between the fitting pawls and the fitting concaved parts.

In addition to the embodiments mentioned above, the present invention includes a variety of embodiments. For example, the present invention includes embodiments wherein the housing is fitted onto an article by using an adhesive, and embodiments wherein the housing is fitted onto an article by using a tape or the like, which achieves fitting by a frictional force, for example, Velcro fastener.

With the description of these embodiments, the first electric connector, which was described in the summary of the invention, has been fully disclosed. Moreover, with the description of these embodiments, the second electric connector and the third electric connector, which will be described below, have been fully disclosed.

The second electric connector is an electric connector as recited in the first electric connector wherein the retainer comprises a cover that fits into the receiving groove and an arm that fits onto the housing. With this arrangement, when the connecting part of the contact is connected to the electric wire of the first article by crimping or insulation displacement connection, then the retainer is fitted into the receiving groove and the arm is fitted onto the housing, the retainer will be fitted onto the housing. Accordingly, the retainer can be easily fitted onto the housing with a single touch.

The third electric connector is an electric connector as recited in the first electric connector wherein the retainer comprises a plate-shaped cover, which covers the front face of the housing and is rotatably joined to the housing at one end thereof, and in which a window for allowing the contacting part of the contact to come out is formed, and an arm for fitting the cover onto the housing. With this arrangement, when the cover is rotated away from the front face of the housing, the connecting part of the contact is connected to the electric wire of the first article by crimping or insulation displacement connection, then the cover is rotated to cover the front face of the housing, and the arm is fitted onto the housing, the retainer will be fitted onto the housing. Accordingly, the retainer can be easily fitted onto the housing with a single touch, and moreover, as the retainer is joined to the housing, the number of parts is reduced and this is advantageous from the viewpoint of management.

What is claimed is:

1. An electric connector for electrically connecting an electric wire of a first article to a conductive part of a second article, said electric connector comprising:

a housing, which is fitted onto at least one of the articles and is provided with a receiving groove that has an open front at, and is recessed into, a front face of the housing, which faces, when connected, toward the conductive part of the second article, and wherein the receiving groove is open at a first end thereof in a first side face of the housing and closed at a second end thereof at a second side face of the housing, a contact, which is inserted into and fitted onto the receiving groove, and which comprises a connecting part to be connected to the electric wire of the first article by crimping or insulation displacement connection and a contacting part which is located closer than the connecting part to the closed second end of the receiving groove and which is to contact the conductive part of the second article, and a retainer, which covers at least a portion of the open front of the receiving groove adjacent to the open first end thereof and is fitted onto the housing, wherein the retainer comprises a plate-shaped cover, which covers the front face of the housing and is rotatably joined to the housing at an edge of the cover, and in which an open area is formed for allowing the contacting part of the contact to come out therethrough, and an arm for fitting the cover onto the housing.

2. The electric connector according to claims 1, wherein the open area is a window bounded within the plate-shaped cover.

3. The electric connector according to claim 1, wherein the arm adjoins and protrudes from another edge of the cover, other than the edge of the cover that is rotatably joined to the cover.

4. The electric connector according to claim 1, wherein the edge of the cover that is rotatably joined to the housing is located adjacent to a side face of the housing other than the first side face of the housing.

5. The electric connector according to claim 4, wherein the side face other than the first side face of the housing is the second side face of the housing.

6. An electrical connector comprising:

an electrically insulating housing having a front face, plural side faces including opposite first and second side faces adjoining said front face, and a receiving groove that extends longitudinally from said first side face toward said second side face, and that has a groove opening in said front face, an open groove end in said first side face, and a closed groove end adjacent to said second side face;

an electrically conductive contact member that is arranged in said receiving groove and that comprises a wire connector adapted to be connected to an electric wire and a contacting part which protrudes out of said receiving groove through said groove opening, wherein said wire connector is located adjacent to said open groove end and said contacting part is located relatively closer than said wire connector to said closed groove end; and a retainer comprising a plate-shaped cover and a retainer arm protruding from said plate-shaped cover, wherein said plate-shaped cover has an open area and is pivotally connected to said housing so as to be pivotable between a closed position and an open position relative to said housing, and wherein, in said closed position, said plate-shaped cover covers at least a portion of said front face and of said groove opening adjacent to said first side face, said contacting part protrudes out of said receiving groove through said open area of said cover, and said retainer arm is releasably secured to said housing.

7. The electrical connector according to claim 6, wherein said open area is a window opening bounded within said plate-shaped cover.

8. The electrical connector according to claim 6, wherein said retainer arm protrudes from an edge of said plate-shaped cover located away from a location where said plate-shaped cover is pivotally connected to said housing.

9. The electrical connector according to claim 6, wherein said plate-shaped cover is pivotally connected to said housing at an edge of said plate-shaped cover adjacent to one of said side faces of said housing other than said first side face.

10. The electrical connector according to claim 9, wherein said edge of said plateshaped cover is adjacent to and pivotally connected to said second side face of said housing.

* * * * *

UNITED STATES PATENT AND TRADEMARK OFFICE

CERTIFICATE OF CORRECTION

PATENT NO. : 6,589,082 B2
DATED : July 8, 2003
INVENTOR(S) : Harasawa et al.

It is certified that error appears in the above-identified patent and that said Letters Patent is hereby corrected as shown below:

Title page,
Item [75], Inventors, before "Kawasaki", "Kihara" should read -- Kihira --.

Column 1,
Line 6, after "and", replace "10/017,087," by -- 10/017,987, --.

Column 7,
Line 14, before "recessed", replace "grooveshaped" by -- groove-shaped --.

Column 8,
Line 20, after "the", replace "abovementioned" by -- above-mentioned --;
Line 24, after "this", replace "fittingin" by -- fitting-in --;
Line 40, before "cover", replace "plateshaped" by -- plate-shaped --.

Column 10,
Line 64, before "force", replace "fittingin" by -- fitting-in --.

Column 14,
Line 21, before "cover", replace "plateshaped" by -- plate-shaped --.

Signed and Sealed this

Second Day of December, 2003

JAMES E. ROGAN
*Director of the United States Patent and Trademark Office*